US005833005A

United States Patent [19]

Woolcock

[11] Patent Number: 5,833,005

[45] Date of Patent: Nov. 10, 1998

[54] FOG PRODUCING FIRE-FIGHTING SYSTEM

[76] Inventor: Mel Woolcock, 27937 Pueblo Calle, Hayward, Calif. 94545

[21] Appl. No.: 911,464

[22] Filed: Aug. 14, 1997

[51] Int. Cl.[6] ..... A62C 35/00

[52] U.S. Cl. ..... 169/5; 169/13; 169/14

[58] Field of Search ..... 239/14.1, 77; 169/5, 169/13, 14, 29, 30, 91

[56] References Cited

U.S. PATENT DOCUMENTS

| | | | |
|---|---|---|---|
| 2,515,792 | 7/1950 | Ofeldt | 239/77 X |
| 3,186,490 | 6/1965 | Jamison et al. | 169/14 X |
| 3,244,235 | 4/1966 | Jamison | 169/14 |
| 3,607,779 | 9/1971 | King et al. | 169/14 X |
| 4,886,233 | 12/1989 | Bateman et al. | 169/91 X |
| 5,062,487 | 11/1991 | Siria et al. | 169/91 |

FOREIGN PATENT DOCUMENTS

| | | | |
|---|---|---|---|
| 139392 | 1/1980 | Germany | 169/14 |

*Primary Examiner*—Andres Kashnikow
*Assistant Examiner*—Robin O. Evans

[57] ABSTRACT

A new fog producing fire-fighting system for aiding in fighting brush and structural fires. The inventive device includes a housing having a central exhaust tube therethrough. The exhaust tube has a front opening and a rear opening. A motorized fan is disposed within the rear opening in the central exhaust tube. The motorized fan faces towards the rear opening of the exhaust tube. A water pump is secured the rear wall of the housing. The pump has a water inlet and a water outlet. The water inlet couples with a standard water hose. A water outlet tube couples with the water outlet of the water pump. The water outlet tube includes a vertical tube extending inwardly of the exhaust tube intermediately disposed between the front opening and the rear opening thereof. The vertical tube has a plurality of linearly disposed apertures on diametrically opposing sides thereof.

5 Claims, 3 Drawing Sheets

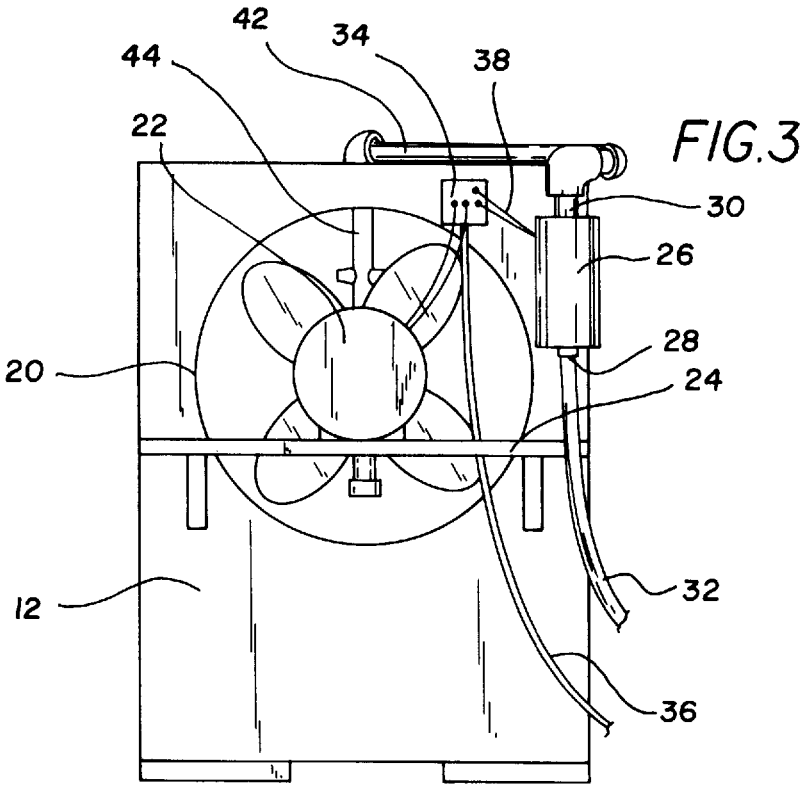
FIG.3
FIG.4
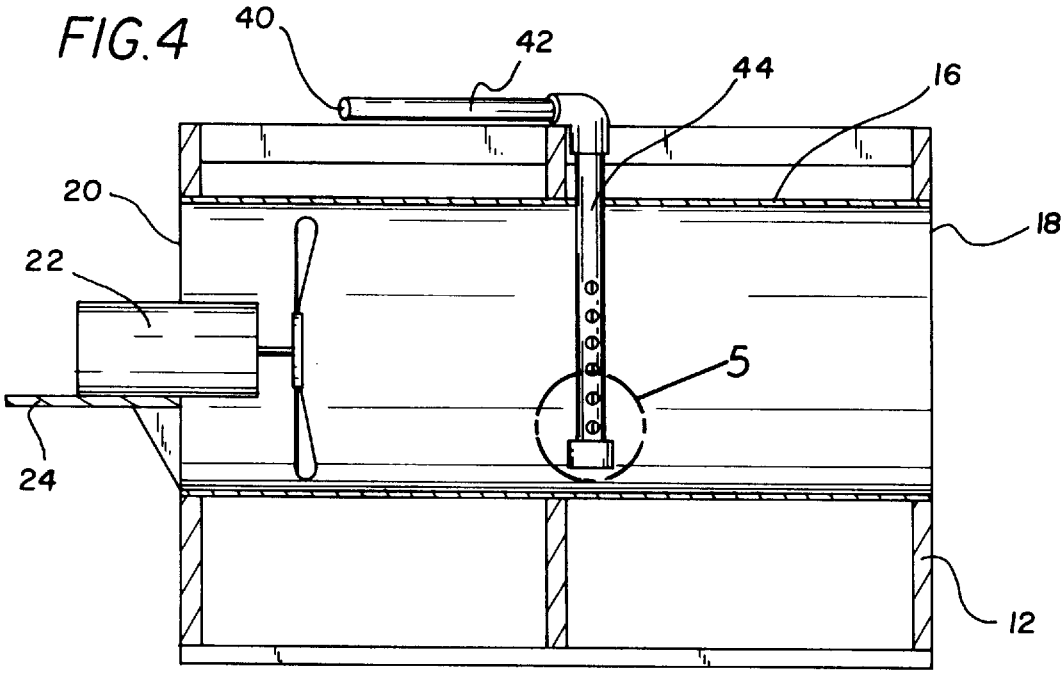

FOG PRODUCING FIRE-FIGHTING SYSTEM

BACKGROUND OF THE INVENTION

1. Field of the Invention

The present invention relates to fog makers and more particularly pertains to a new fog producing fire-fighting system for aiding in fighting brush and structural fires.

2. Description of the Prior Art

The use of fog makers is known in the prior art. More specifically, fog makers heretofore devised and utilized are known to consist basically of familiar, expected and obvious structural configurations, notwithstanding the myriad of designs encompassed by the crowded prior art which have been developed for the fulfillment of countless objectives and requirements.

Known prior art fog makers include U.S. Pat. No. 5,253,716 to Mitchell; U.S. Pat. No. 4,278,617 to Rahman; U.S. Pat. No. 4,657,712 to Milbocker; U.S. Pat. No. 4,174,362 to Rahman; U.S. Pat. No. Des. 353,873 to Schoeneman; and U.S. Pat. No. 5,180,106 to Handfield.

While these devices fulfill their respective, particular objectives and requirements, the aforementioned patents do not disclose a new fog producing fire-fighting system. The inventive device includes a housing having a central exhaust tube therethrough. The exhaust tube has a front opening and a rear opening. A motorized fan is disposed within the rear opening in the central exhaust tube. The motorized fan faces towards the rear opening of the exhaust tube. A water pump is secured the rear wall of the housing. The pump has a water inlet and a water outlet. The water inlet couples with a standard water hose. A water outlet tube couples with the water outlet of the water pump. The water outlet tube includes a vertical tube extending inwardly of the exhaust tube intermediately disposed between the front opening and the rear opening thereof. The vertical tube has a plurality of linearly disposed apertures on diametrically opposing sides thereof.

In these respects, the fog producing fire-fighting system according to the present invention substantially departs from the conventional concepts and designs of the prior art, and in so doing provides an apparatus primarily developed for the purpose of aiding in fighting brush and structural fires.

SUMMARY OF THE INVENTION

In view of the foregoing disadvantages inherent in the known types of fog makers now present in the prior art, the present invention provides a new fog producing fire-fighting system construction wherein the same can be utilized for aiding in fighting brush and structural fires.

The general purpose of the present invention, which will be described subsequently in greater detail, is to provide a new FOG producing fire-fighting system apparatus and method which has many of the advantages of the fog makers mentioned heretofore and many novel features that result in a new fog producing fire-fighting system which is not anticipated, rendered obvious, suggested, or even implied by any of the prior art fog makers, either alone or in any combination thereof.

To attain this, the present invention generally comprises a housing having a generally rectangular configuration. The housing has an open upper end, a closed lower end, a front wall, a rear wall and opposed open side walls. The housing has a central divider panel disposed between the front wall and rear wall thereof. A central exhaust tube extends through the housing and has open ends disposed within the front wall and rear wall of the housing. The exhaust tube has a front opening and a rear opening. A motorized fan is disposed within the rear opening in the central exhaust tube. The motorized fan faces towards the rear opening of the exhaust tube. A water pump is secured the rear wall of the housing. The pump has a water inlet and a water outlet. The water inlet couples with a standard water hose. A junction box is secured to the rear wall of the housing. The junction box has a power line extending outwardly therefrom for coupling with an electrical outlet. The junction box is in electrical communication with the motorized fan and the water pump. A water outlet tube couples with the water outlet of the water pump. The water outlet tube includes a horizontal tube and a vertical tube. The horizontal tube extends outwardly from the water pump to a central position above the open upper end of the housing. The vertical tube extends downwardly through the open upper end of the housing and inwardly of the exhaust tube intermediately disposed between the front opening and the rear opening thereof. The vertical tube has a plurality of linearly disposed apertures on diametrically opposing sides thereof. Each of the apertures have misting tips coupled thereto. The misting tips are defined by elongated slotted openings therethrough.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fog producing fire-fighting system apparatus and method which has many of the advantages of the fog makers mentioned heretofore and many novel features that result in a new fog producing fire-fighting system which is not anticipated, rendered obvious, suggested, or even implied by any of the prior art fog makers, either alone or in any combination thereof.

It is another object of the present invention to provide a new fog producing fire-fighting system which may be easily and efficiently manufactured and marketed.

It is a further object of the present invention to provide a new fog producing fire-fighting system which is of a durable and reliable construction.

An even further object of the present invention is to provide a new fog producing fire-fighting system which is susceptible of a low cost of manufacture with regard to both materials and labor, and which accordingly is then susceptible of low prices of sale to the consuming public, thereby making such fog producing fire-fighting system economically available to the buying public.

Still yet another object of the present invention is to provide a new fog producing fire-fighting system which provides in the apparatuses and methods of the prior art some of the advantages thereof, while simultaneously overcoming some of the disadvantages normally associated therewith.

Still another object of the present invention is to provide a new fog producing fire-fighting system for aiding in fighting brush and structural fires.

Yet another object of the present invention is to provide a new fog producing fire-fighting system which includes a housing having a central exhaust tube therethrough. The exhaust tube has a front opening and a rear opening. A motorized fan is disposed within the rear opening in the central exhaust tube. The motorized fan faces towards the rear opening of the exhaust tube. A water pump is secured the rear wall of the housing. The pump has a water inlet and a water outlet. The water inlet couples with a standard water hose. A water outlet tube couples with the water outlet of the water pump. The water outlet tube includes a vertical tube extending inwardly of the exhaust tube intermediately disposed between the front opening and the rear opening thereof. The vertical tube has a plurality of linearly disposed apertures on diametrically opposing sides thereof.

Still yet another object of the present invention is to provide a new fog producing fire-fighting system that quickly and effectively extinguishes or at least contain a fire.

Even still another object of the present invention is to provide a new fog producing fire-fighting system that could be simply attached to a standard garden hose.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a rear elevation view of the present invention.

FIG. 4 is a cross-sectional view of the present invention as taken along line 4—4 of FIG. 1.

DESCRIPTION OF THE PREFERRED EMBODIMENT

Figure 1:
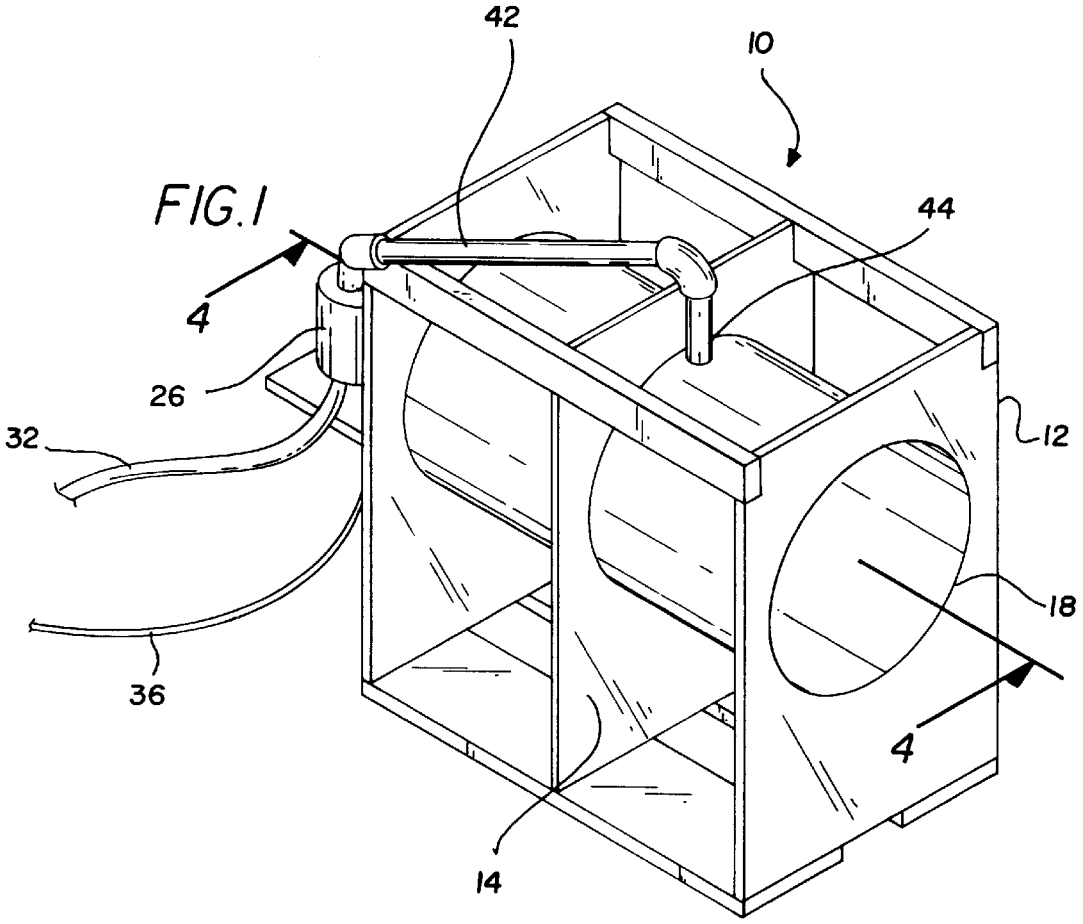
FIG. 1 is a perspective view of a new fog producing fire-fighting system according to the present invention.
Figure 2:
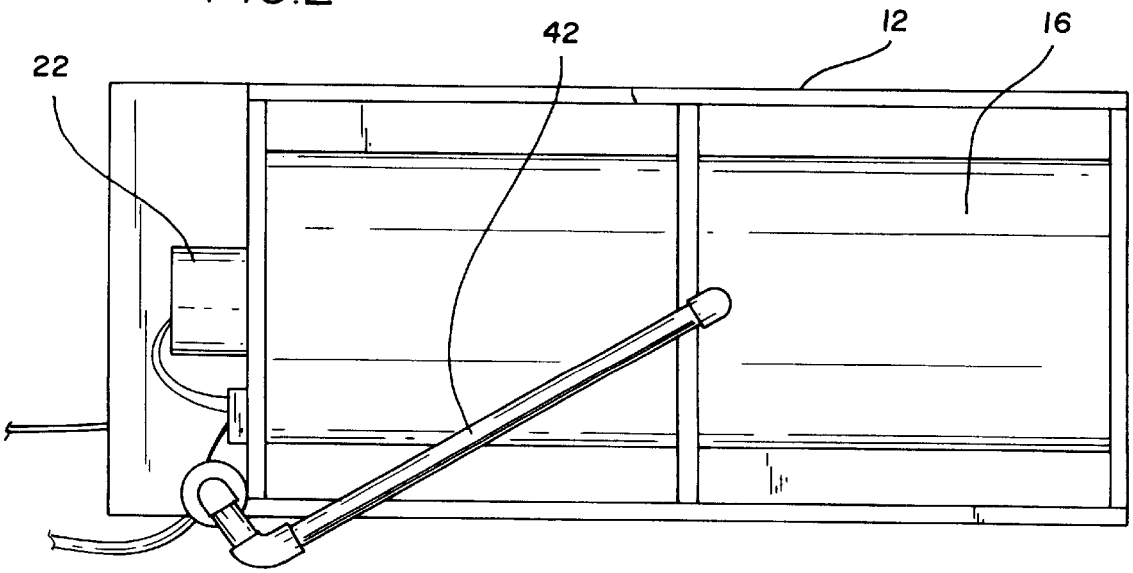
FIG. 2 is a top plan view of the present invention.
Figure 5:
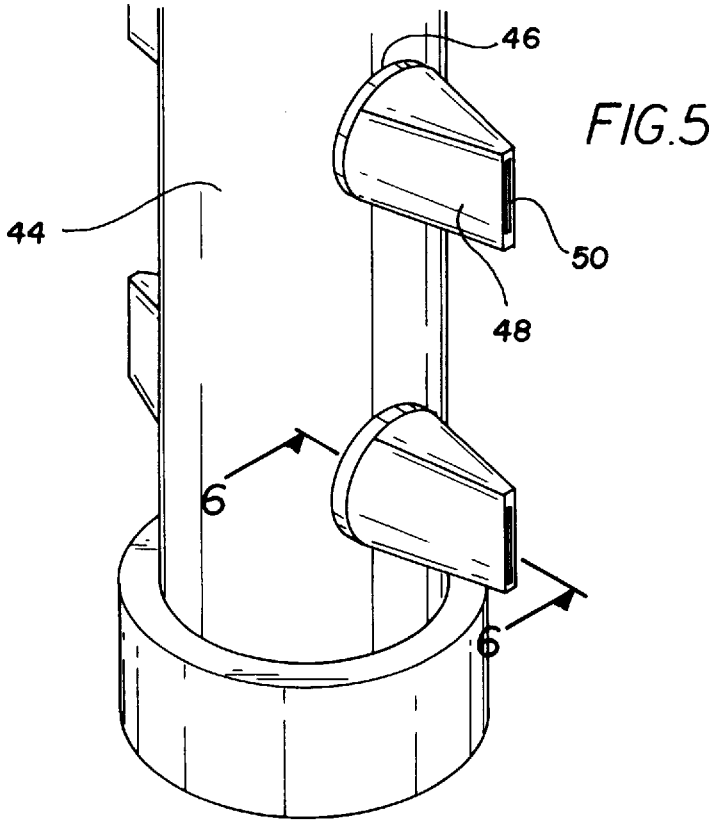
FIG. 5 is a sectional view of the water tube of the present invention as taken from circle 5 of FIG. 4.
Figure 6:
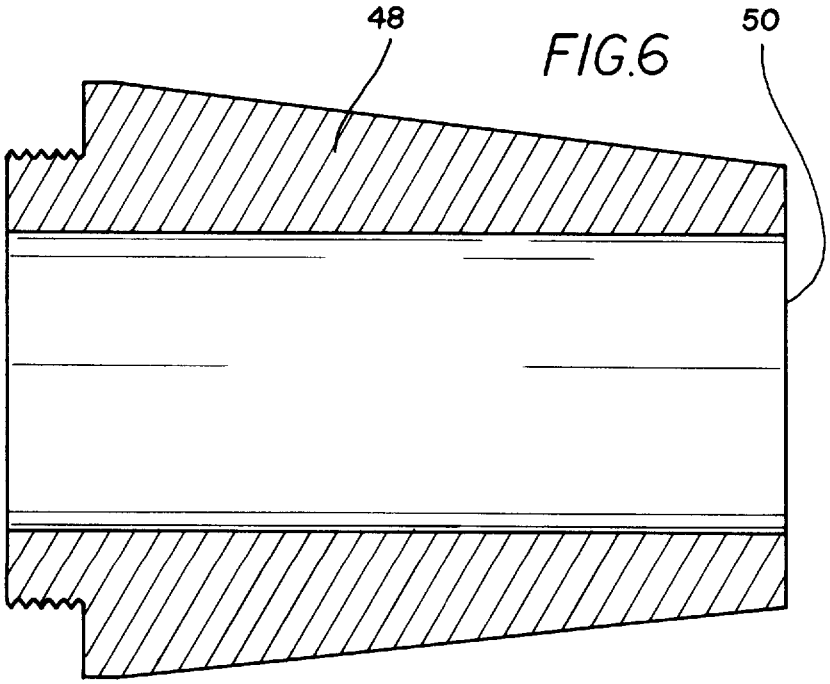
FIG. 6 is a cross-sectional view of the present invention as taken along line 6—6 of FIG. 5.

With reference now to the drawings, and in particular to FIGS. 1 through 6 thereof, a new fog producing fire-fighting system embodying the principles and concepts of the present invention and generally designated by the reference numeral 10 will be described.

As best illustrated in FIGS. 1 through 6, the fog producing fire-fighting system 10 comprises a housing 12 having a generally rectangular configuration. The housing 12 has an open upper end, a closed lower end, a front wall, a rear wall and opposed open side walls. The housing 12 has a central divider panel 14 disposed between the front wall and rear wall thereof.

A central exhaust tube 16 extends through the housing 12 and has open ends disposed within the front wall and rear wall of the housing 12. The exhaust tube 16 has a front opening 18 and a rear opening 20.

A motorized fan 22 is disposed within the rear opening 20 in the central exhaust tube 16. The motorized fan 22 faces towards the front opening 18 of the exhaust tube 16. The fan 22 are secured on a shelf 24 extending across the rear wall of the housing 12.

A water pump 26 is secured the rear wall of the housing 12. The pump 26 has a water inlet 28 and a water outlet 30. The water inlet 28 couples with a standard water hose 32.

A junction box 34 is secured to the rear wall of the housing 12. The junction box 34 has a power line 36 extending outwardly therefrom for coupling with an electrical outlet. The junction box 34 is in electrical communication with the motorized fan 22 and the water pump 26 via electrical lines 38.

A water outlet tube 40 couples with the water outlet 30 of the water pump 26. The water outlet tube 40 includes a horizontal tube 42 and a vertical tube 44. The horizontal tube 42 extends outwardly from the water pump 26 to a central position above the open upper end of the housing 12. The vertical tube 44 extends downwardly through the open upper end of the housing 12 and inwardly of the exhaust tube 16 intermediately disposed between the front opening 18 and the rear opening 20 thereof. The vertical tube 44 has a plurality of linearly disposed apertures 46 on diametrically opposing sides thereof. Each of the apertures 46 have misting tips 48 coupled thereto. The misting tips 48 are defined by elongated slotted openings 50 therethrough.

In use, the water hose 32 is connected to the water inlet 28 of the water pump 26. The power line 36 is then plugged into the electrical outlet to activate the system 10. The activation of the system 10 will power the water pump 26 and the motorized fan 22. The water pump 26 will transport water through the water outlet tube 40 and dispel the water outwardly of the misting tips 48 in a misty spray whereby the fan 22 will serve to blow the created mist outwardly of the front opening 18 of the central exhaust tube 16. The front opening 18 should be directed towards the fire area.

Alternate features to the system could be incorporated such as a battery powered system for smaller at home applications and a combustion engine-powered system designed for use with professional fire fighters. The components of the system would be essentially the same except for the size and range of use.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fog producing fire-fighting system for aiding in fighting brush and structural fires comprising, in combination:

a housing having a generally rectangular configuration, the housing having an open upper end, a closed lower end, a front wall, a rear wall and opposed open side walls, the housing having a central divider panel disposed between the front wall and rear wall thereof;

a central exhaust tube through the housing and having open ends disposed within the front wall and rear wall of the housing, the exhaust tube having a front opening and a rear opening;

a motorized fan disposed within the rear opening in the central exhaust tube, the motorized fan facing towards the front opening of the exhaust tube;

a water pump secured the rear wall of the housing, the pump having a water inlet and a water outlet, the water inlet coupling with a standard water hose;

a junction box secured to the rear wall of the housing, the junction box having a power line extending outwardly therefrom for coupling with an electrical outlet, the junction box being in electrical communication with the motorized fan and the water pump; and a water outlet tube coupling with the water outlet of the water pump, the water outlet tube including a horizontal tube and a vertical tube, the horizontal tube extending outwardly from the water pump to a central position above the open upper end of the housing, the vertical tube extending downwardly through the open upper end of the housing and inwardly of the exhaust tube intermediately disposed between the front opening and the rear opening thereof, the vertical tube having a plurality of linearly disposed apertures on diametrically opposing sides thereof, each of the apertures having misting tips coupled thereto, the misting tips being defined by elongated slotted openings therethrough.

2. A fog producing fire-fighting system for aiding in fighting brush and structural fires comprising, in combination:

a housing having a central exhaust tube therethrough, the exhaust tube having a front opening and a rear opening;

a motorized fan disposed within the rear opening in the central exhaust tube, the motorized fan facing towards the front opening of the exhaust tube;

a water pump secured the rear wall of the housing, the pump having a water inlet and a water outlet, the water inlet coupling with a standard water hose; and a water outlet tube coupling with the water outlet of the water pump, the water outlet tube including a vertical tube extending inwardly of the exhaust tube intermediately disposed between the front opening and the rear opening thereof, the vertical tube having a plurality of linearly disposed apertures on diametrically opposing sides thereof.

3. The fog producing fire-fighting system as set forth in claim 2 wherein each of the apertures have misting tips coupled thereto.

4. The fog producing fire-fighting system as set forth in claim 3 wherein the misting tips are defined by elongated slotted openings therethrough.

5. The fog producing fire-fighting system as set forth in claim 2 and further including a junction box secured to a rear wall of the housing, the junction box having a power line extending outwardly therefrom for coupling with an electrical outlet, the junction box being in electrical communication with the motorized fan and the water pump.

* * * * *